US005841669A

United States Patent [19]

Purvis et al.

[11] Patent Number: 5,841,669

[45] Date of Patent: Nov. 24, 1998

[54] SOLIDIFICATION CONTROL INCLUDING PATTERN RECOGNITION

[75] Inventors: Andrew L. Purvis, Delavan, Ill.; Christopher R. Hanslits, Zuni, Va.; Randall S. Diehm, Whitehall, Mich.

[73] Assignee: Howmet Research Corporation, Whitehall, Mich.

[21] Appl. No.: 592,723

[22] Filed: Jan. 26, 1996

[51] Int. Cl.[6] ..... B22D 25/00

[52] U.S. Cl. ..... 364/554; 364/150; 148/404; 164/4.1; 164/122

[58] Field of Search ..... 364/496, 552, 364/554, 468.17, 468.04, 138, 148–151; 148/404; 164/1, 47, 122–122.1, 4.1–45.7, 154.1; 395/1, 10, 20–22, 902, 903, 906

[56] References Cited

U.S. PATENT DOCUMENTS

| | | | |
|---|---|---|---|
| 3,931,847 | 1/1976 | Terkelsen | 164/4 |
| 4,190,094 | 2/1980 | Giamei | 164/60 |
| 4,813,470 | 3/1989 | Chiang | 164/122.1 |
| 5,111,531 | 5/1992 | Grayson et al. | 395/23 |
| 5,136,497 | 8/1992 | Coe et al. | 364/165 |
| 5,309,876 | 5/1994 | Prichard et al. | 164/457 |
| 5,385,200 | 1/1995 | Yuki et al. | 164/457 |
| 5,486,995 | 1/1996 | Krist et al. | 364/149 |

OTHER PUBLICATIONS

Importance of Thermal Parameters as Vector Components During Solidification Modeling of Single–Crystal Investment Casting; AFS Transactions; pp. 637–644, Purvis et al, Mar., 1995.

The Application of Pattern Recognition as Defect Prediction Tool in Solidification Modeling of Single Crystal Investment Castings, Purvis and Hanslits, Sep., 1995.

Computation of Thermal Gradient during Solidification; Modeling of Single Crystal Investment Castings, Howmet Corporation, EPD Congress 1994, pp. 925–940. Dec. '94.

Modeling Characteristics for Solidification in Single–Crystal, Investment–Cast Superalloys, JOM, Jan. 1994, pp. 38–41, A.L. Purvis, et al.

Acoustic Emission Analysis using Pattern Recognition, Pacific Northwest Laboratories, T.P. Harrington, et al pp. 1204–1207, Jun. 1980.

Application of Pattern Recognition Techniques in the Identification of Acoustic Emission Signals, W.Y. Chan, et al pp. 108–111, 1980.

Linear Discriminant Function Analysis of Acoustic Emission Signals for Cutting Tool Monitoring, Mech. Sys. Sig. Proces. (1987) I(4), pp. 333–347, E. Kannate–Astbu, et al. Dec. '1987.

Classification of Acoustic Emission Signals from deformation Mechanisms in Aluminum Alloys, J. Acou. Emis., vol. 3, No. 3. pp. 118–129, D. Robert Hay, et al. Dec '84.

A Method of Shrinkage Prediction and Its Application to Steel Casting Practice,AFS Int. Cast Metals Journal, Sep. 1982, pp. 52–63, E. Niyama, et al.

Considerations of Sample and Fearute Size, IEEE Trans. Info. Theory, vol. IT–18, No. 5, Sep. 1972, pp. 618–626.

Modeling of Feeding Behavior of Solidifying Al–7Si–0.3Mg Alloy Plate Casting, Metallurgical Transactions B, vol. 21B, Aug. 1990, pp. 715–722.

*Primary Examiner*—James P. Trammel
*Assistant Examiner*—Craig Steven Miller
*Attorney, Agent, or Firm*—Edward J. Timmer

[57] ABSTRACT

A method of predicting a grain condition in a directionally solidified casting, comprises generating thermal history data for a directional solidification casting process, determining a plurality of casting process variables that statistically influence a plurality of different grain conditions, identifying each grain condition by determining a function containing values of each selected variable, and categorizing the selected variables with respect to variance among and between the different grain conditions to determine a pattern between the selected variable and the grain conditions.

5 Claims, 6 Drawing Sheets

INITIAL PROCESS WITH SEVERE BOUNDARY DEFECTS

| DEFECT MAP PREDICTION | |
|---|---|
| DS/SC | 8.5% |
| EQUIAX | 0.3% |
| FRECKLES | 91.0% |

IMPROVED PROCESS WITH BOUNDARY DEFECTS

| DEFECT MAP PREDICTION | |
|---|---|
| DS/SC | 9.6% |
| EQUIAX | 0.9% |
| FRECKLES | 89.4% |

OPTIMIZED PROCESS WITHOUT BOUNDARY DEFECTS

| DEFECT MAP PREDICTION | |
|---|---|
| DS/SC | 39.3% |
| EQUIAX | 0.1% |
| FRECKLES | 60.5% |

SOLIDIFICATION CONTROL INCLUDING PATTERN RECOGNITION

FIELD OF THE INVENTION

The present invention relates to casting of molten metallic materials and, more particularly, to grain prediction in connection with directional solidification casting such as single crystal and columnar grain casting.

BACKGROUND OF THE INVENTION

Directional solidification of columnar grain and single crystal castings of superalloys is in widespread use in the manufacture of components, such as gas turbine engine blades and vanes, that must withstand high temperature and stress service conditions in the turbine section of the gas turbine engine. Past studies of crystal growth in molten superalloys has resulted in what is called a soldification map or defect map which outlines the conditions encountered during the single crystal soldification process which have led to specific morphologies of the solidification front or even defective grain conditions in terms of thermal gradient (G) and solidification rate (R). Construction of these maps often is performed using very simple cylindrical or plate shaped castings under noiseless research conditions by relating the resultant casting microstructure to the casting parameters used. These maps can help explain the occurrence of grain defects in connection with the casting of simple shapes such as stacked cylinders.

Among the assumptions often used in map constructions are constant processing parameters such as thermal gradient (G) or solidification rate (R) as indicated by the cast microstructure. However, these assumptions are often in contrast to the variable component geometries and casting conditions encountered in production environments. As a result, such maps have yielded inconsistent findings when applied to complex geometries, such as the complex shapes of gas turbine engine blades in use in modern gas turbine engines, and production casting conditions.

In particular, studies have shown that for the highly sensitive requirements of production gas turbine single crystal and other directionally solidified components, the G and R parameters used for the defect maps are not sufficiently sensitive to account for the numerous changes in the soldification front required by these complex components. There has been a correlation of G and R values to dendrite arm spacing in the microstructure, but this too has been able to only trace trends in the predicted and actual microstructures.

Given the demanding scope of of the aerospace and gas turbine engine industries for salable single crystal and other directionally solidified components and allowable number of casting defects (grain defects), there is a need for an improvement in grain defect prediction beyond the approximations offered by defect maps to reduce or minimize unwanted grain defects in single crystal and other directionally solidified castings.

SUMMARY OF THE INVENTION

The present invention has an object to satisfy this need for improved grain prediction and directional solidification casting process control by using a technique known as pattern recognition to compare data which define certain grain conditions as defect categories extracted from solidification models of shaped cast components. The present invention involves generating data which will define solidification features or variables which promote ideal single crystal growth as well as defective grain conditions found commonly in single crystal and directionally solidified production castings. Each grain condition is treated as a category such that statistics can be generated about each category. Those macroscopic solidification features or variables which best distinguish the defined grain category from others are used in a defect prediction criteria. Macroscopic features or variables extracted from the thermal history of several model components are used to define a range of values for each category and those defined characteristics of soldification are used to establish the defect prediction criteria for other components.

In one embodiment of the invention, four grain conditions are used including single crystal grain, equiaxed grains, columnar grains, and freckle defects (comprised of a string of equiaxed grains) found commonly in single crystal and and directionally solidified production castings. Baseline computer solidification models are used which define these grain conditions in terms of various thermal history data obtained from the models, related to the thermal history gradient (G) and rate of solidification (R) for the single crystal investment castings. The baseline solidification data from the computer models can be augmented with thermal history data obtained from resolving G and R values into vector components and from other criteria functions. Statistical anaylsis on the baseline data is used to determine the statisical influence of each of several solidification features or variables on the categorization of the baseline data. The relative influence of selected features or variables in identifying the grain conditions is determined by using pattern recognition analysis, such as developing least square 3 variable linear discriminant functions or equations using the influential features to provide improved identification of the grain conditions. The baseline or training data then can be tested with laboratory and production shaped solidification models to categorize the thermal history and compare directly with the baseline models of the laboratory and production shaped castings. Numerical categorization in this manner consistent with experimental casting results permits casting process variable changes to be determined that reduce or eliminate the unwanted grain condition(s) in different casting shapes.

DESCRIPTION OF THE INVENTION

Figure 1A:
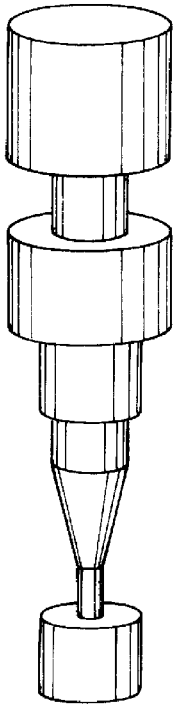
FIGS. 1*a* and 1*b* are schematic perspective views of modular test casting and a mold cluster to cast same used for the model to generate thermal history data for the freckle defects category.
Figure 1B:
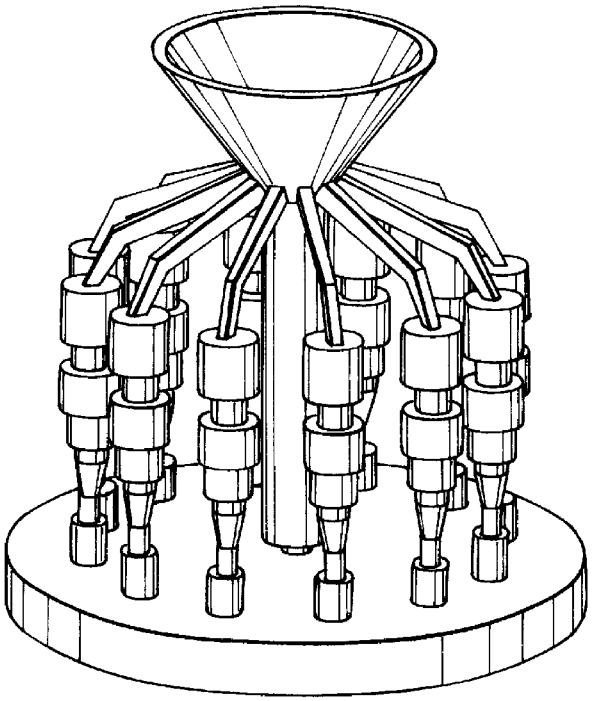

The present invention provides improved grain defect prediction by using a technique known as pattern recognition to compare data which define certain grain conditions and grain defect categories, extracted from solidification models of shaped cast components. Pattern recognition analysis is a technique most commonly employed in signal processing. Input sources are categorized using statistical comparisons of various features or varibles. A linear discriminant function (LDF) equation is then developed which defines each category. Using ranked features which describe an input source, the LDF equations will "recognize" patterns contained within a number of these features and compare those trends against the definitions of all source categories. This technique is used extensively in voice recognition systems, where decomposed signals are compared against those which define a specific category, allowing for normal variance in the input signal. The resultant output is a Baysean decision based on numerical output from the LDF equation of each category. The numerical techinques and the overall approach used in the practice of the present invention are similar to a study reported by Kannatey-Asibu and Emel in Mech. Systems and Signal Processing, 4, 1987, pp. 333–347, the teachings of which are incorporated herein by reference. Appendix A hereto includes the fundamental numerical techniques disclosed in the Kannatey-Asibu and Emel article and used in the practice of the present invention.

With respect to grain defect prediction in a single crystal casting process in accordance with the present invention, a feature is defined as one input, such as G (thermal gradient), R (solidification rate), and others to be described herebelow extracted from the thermal history of a node in a computer solidification model of the single crystal casting process. A description of some solidification functions used as features or variables in the embodiment of the present invention described herebelow are set forth in Appendix B. Additional features or variables used in the embodiment of the invention described herebelow are set forth in Appendic C along with a description of the feature.

Various statistical information is extracted from these features, such as for example variance within a specific category, variance between categories, degree of overlap between categories, and others as set forth in Appendix A (see equations A-2 through A-6). By ranking these features using such statistical techniques (Appendix A, A-7), it can be determined which of the features are influential to solidification and which are insignificant in terms of the categorical statistics.

A category is defined as a grain condition including good single crystal and one or more defective grain conditions. The invention will be described herebelow with respect to four categories of grain condition; namely, 1) single crystal, 2) equiaxed grain, 3) columnar (DS) grain, and 4) freckle defects which comprise a string of equiaxed typically associated with uneven cooling and certain alloy compositions. Since there are four (4) input categories corresponding to the four grain conditions in this illustrative embodiment of the invention, the anaylsis is treated as a 4-dimensional anaylsis.

Table I lists the four grain conditions (categories) and a description of the casting input geometry and shape as well as soldification withdrawal rate(s) and other casting parameters used to define and model each category of grain condition. Table I thereby sets forth solidification models for each grain condition.

TABLE I

| Category | Model | Withdrawal Rate | Notes |
|---|---|---|---|
| Single Crystal Grain | Simple Cylinder (1 × 12) cm. | 15, 19, 25, 30, 34 cm/hr | 2 sizes radiation baffle gap Total Nodes 3210 |

TABLE I-continued

| Category | Model | Withdrawal Rate | Notes |
|---|---|---|---|
| DS Grains-Boundaries | IGT 2nd Blade | 25, 45 cm/hr | Chill plate nodes ignored Total Nodes 1806 |
| Equiaxed Grains | IGT 7th Blade Aero LP Blade | n/a | Nodes near gating ignored Total Nodes 2805 |
| Freckle Defects | Modular Test Casting | 0.5, 1.0 cm/hr | Only defect prone nodes Total Nodes 2910 |

Figure 1C:
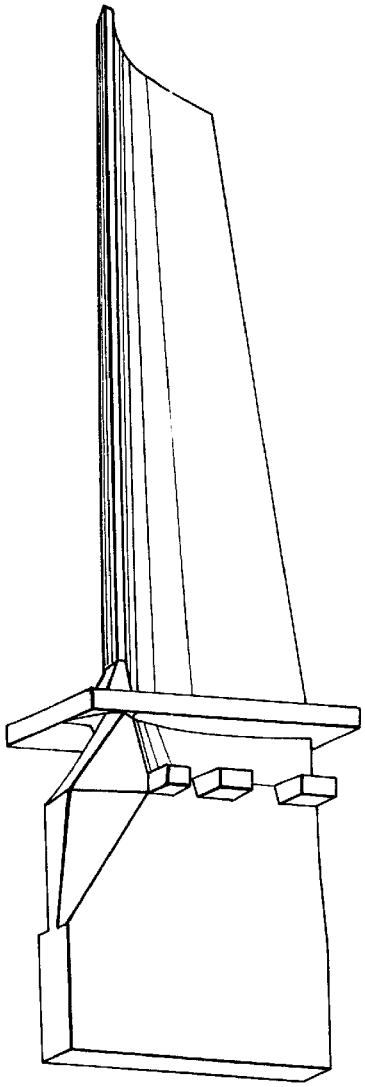
FIGS. 1*c*, 1*d* and 1*e* are schematic perspective views of the IGT 2nd, IGT 7th and Aero blades of Table I, repsectively.
Figure 1D:
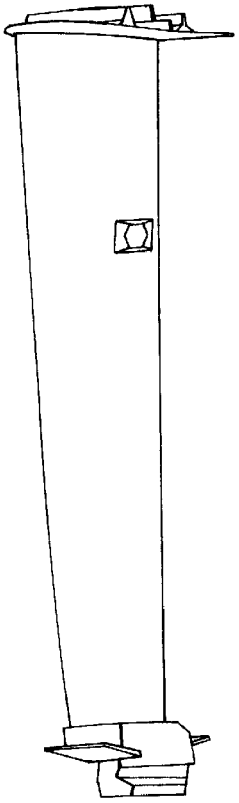
Figure 1E:
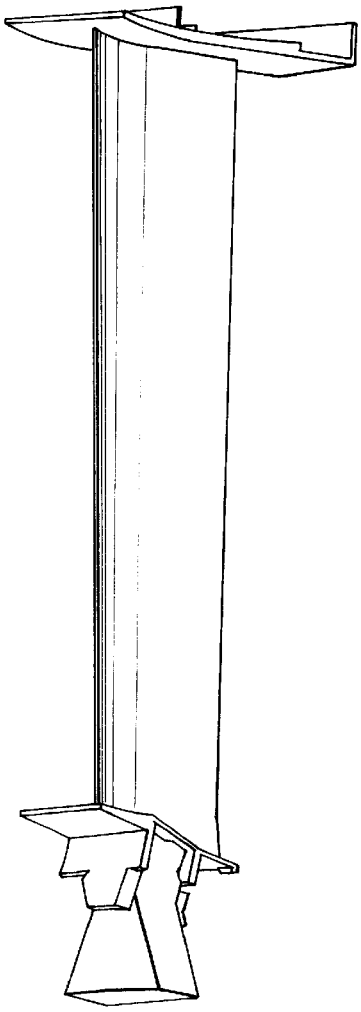

In Table I, for the single crytal model, the two sizes of radiation baffle gaps considered were 0.635 cm and 1.27 cm. For the DS grains-boundaries, an IGT (industrial gas turbine) 2nd blade was modeled and corresponds to an approximately 12 inch long, cored IGT DS, non-shrouded 2nd stage blade, FIG. 1*c*. For the equiaxed grains, an IGT 7th stage low pressure blade (LPB), FIG. 1*d*, and Aero LPB, FIG. 1*e*, were modeled. The IGT blade corresponds to an approximately 8 inch long, solid IGT equiax, shrouded 7th stage blade. The Aero (aerospace gas turbine) LP blade corresponds to an approximately 8 inch long, solid Aero equiax, shrouded 4th stage blade. The withdrawal rate for these models was not applicable (n/a) since equiaxed castings are not withdrawn in the manner that single crystal and DS castings are. The Modular Test Casting is described by Purvis et al. in Journal Of Metals (JOM), 46, 1994, pp. 38–41 and FIGS. 1–2 thereof, the teachings of which are incorporated herein by reference. The Modular Test Casting is shown in FIG. 1*a* for purposes of illustration.

Figure 2:
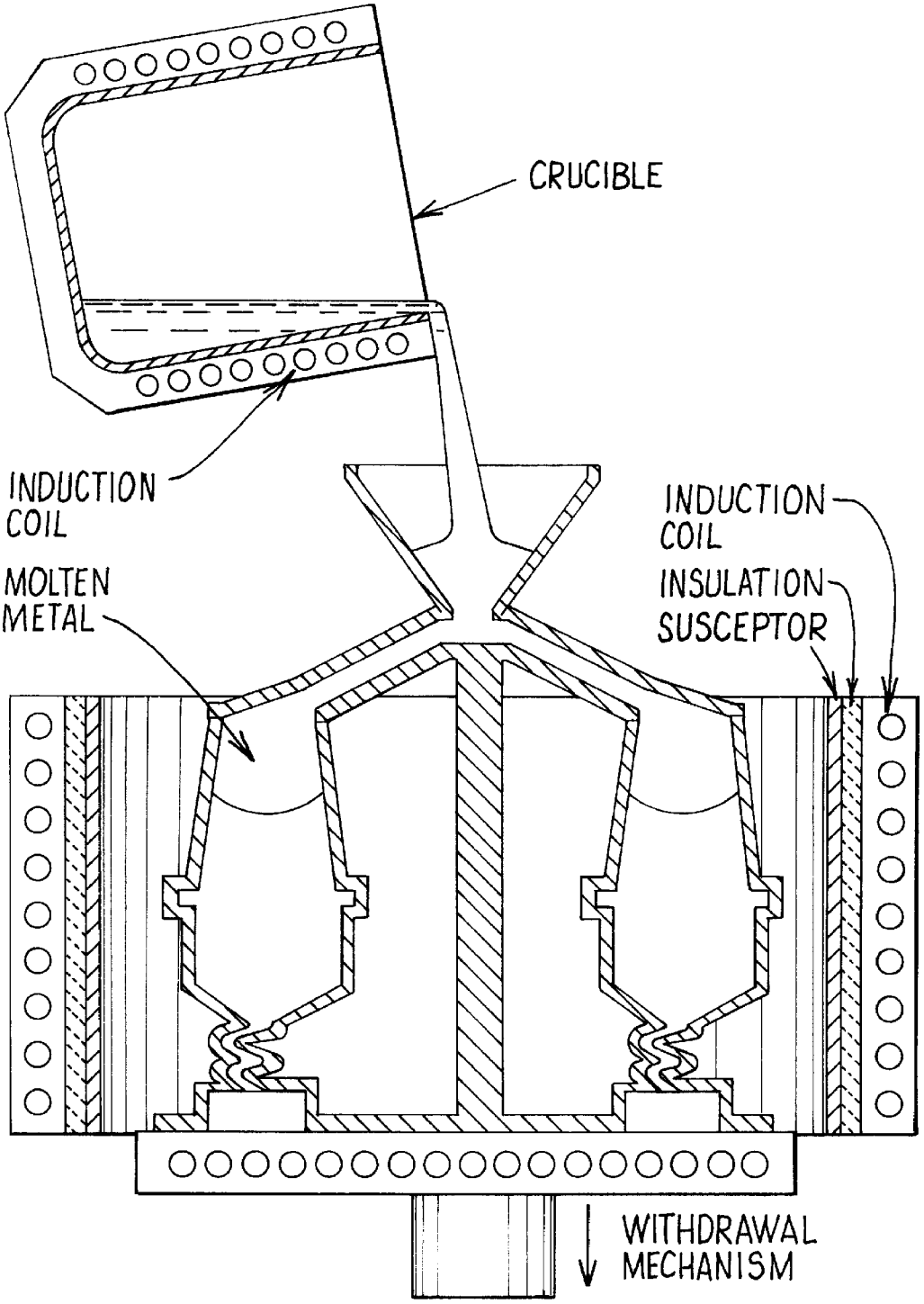
FIG. 2 is a view of single crystal casting furnace and mold used in the heat transfer modeling of the grain categories and subsequent prediction of defects.

Computer numerical computations for the models of Table I were based on parameters of a production Bridgmann type casting furnace, FIG. 2, and various mold clusters ranging from 1 to 12 casting pieces per mold arranged in a circular pattern for the directionally solidfied, single crystal, and freckle castings (e.g. 1 piece for single crystal, 3 pieces for DS grain boundaries, 12 pieces for freckle, e.g. FIG. 1*b*, and 4 to 8 casting pieces for the equiaxed castings (e.g. 4 for IGT stage blade and 8 for Aero LP blade). The castings were modeled and verified using a third generation, high Re, single crystal superalloy known as Rene' N5 alloy. The nominal control temperature of the mold heater (susceptor) hot zone was 1510 degrees C. for the computer model.

The computer model thermal history data for each grain category of Table I can be generated using heat transfer computations performed on an HP 9000-720 Apollo workstation computer using the ProCAST heat transfer finite element software package available from UES Corporation, 175 Admiral Cochrane Drive, Suite 110, Annapolis, Md. 21401. Thermal history data includes temperature and time at each node along with node position in space relative to global Cartesian coordinates. The total nodes available from the computer model for each grain condition are shown in the right hand column of Table I.

Only those nodes which define the grain conditions without question are used in the analysis as defining data. Others nodes, such as nodes near a chill plate or in the gating system of a model, were not considered as indicated in Table I. The models were thermally tuned to match experimental results when necessary by measuring actual thermal conditions with thermocouples and adjusting the model to correspond to measured values.

Following the solidification simulation or modeling, the 41 features or variables listed in Table II relating to thermal history are calculated for each node point of the computer model by finite element analysis solving for temperature/time and then calculating the various variables from the temperaure/time data.

These features or variables are not entirely independent and some overlap between values is expected. The primary purpose of the master data file generated from the extracted features is to define each of the input classes (4 grain categories) with very little error.

TABLE II

| Ran | Variable | Description | Ref. | Q Value |
|---|---|---|---|---|
| 1 | dG/dx-wd | Derivative of Gradient-wd direction | 7 | 45.0 |
| 2 | RL-wd/lat | Ratio of R, wd to lateral @ liquidus | 6 | 44.4 |
| 3 | GAP | Gradient Acceleration Parameter | 16 | 42.7 |
| 4 | RS-wd/lat | Ratio of R, wd to lateral @ solidus | 7 | 42.0 |
| 5 | dG/dx | Derivative of G | 7 | 40.9 |
| 6 | COOL | Ratio of cooling rate wd/lateral | 7 | 40.7 |
| 7 | COOL @ Liq | COOL computed at liquidus | 7 | 40.5 |
| 8 | COOL @ Sol | COOL computed at solidus | 7 | 36.3 |
| 9 | $T_S$ | Local solidification time | | 35.4 |
| 10 | G/R | Equiaxed to columnar transition | | 30.1 |
| 11 | G/R @ Liq | ECT computed at liquidus | | 28.5 |
| 12 | GROW | Ratio of R wd to lateral | 6 | 27.9 |
| 13 | Niyama | Niyama porosity criteria function | 16 | 25.7 |
| 14 | GL-wd | Gradient @ Liquidus - wd direction | 6 | 25.4 |
| 15 | GL | Gradient @ Liquidus | | 24.7 |
| 16 | G*R | Cooling Rate -freckle defect criteria | | 23.9 |
| 17 | Xue | Xue porosity criteria function | 16 | 23.6 |
| 18 | GL-lat | Gradient @ Liquidus - lateral | 6 | 22.8 |
| 19 | G | Gradient | | 22.5 |
| 20 | G-wd | Gradient in wd direction | 6 | 22.4 |
| 21 | G*R-wd | Cooling rate in wd direction | 6 | 22.4 |
| 22 | G-lat | Gradient in lateral direction | 6 | 21.6 |
| 23 | LCC | LCC porosity criteria function | 16 | 19.9 |
| 24 | RL-wd | R @ Liquidus - wd direction | 6 | 18.0 |
| 25 | GS | Gradient @ Solidus | | 17.9 |
| 26 | GS-wd | Gradient @ Solidus - wd direction | 6 | 17.8 |
| 27 | MAR | Mushy Zone Acceleration Ratio | 7 | 17.8 |
| 28 | MAR-lat | MAR - lateral direction | 7 | 17.8 |
| 29 | GS-lat | Gradient @ Solidus - lateral | 6 | 17.7 |
| 30 | RS-wd | R @ Solidus - wd direction | 6 | 17.1 |
| 31 | G/R-S | ECT @ Solidus | | 17.0 |
| 32 | R-wd | R - wd direction | 6 | 15.7 |
| 33 | MAR-wd | MAR - wd direction | 7 | 15.5 |
| 34 | G*R-lat | Cooling rate - lateral direction | 6 | 14.6 |
| 35 | R | Solidification rate | | 14.3 |
| 36 | RS | R @ Solidus | | 14.3 |
| 37 | RL | R @ Liquidus | | 14.1 |
| 38 | RS-lat | R @ Solidus - lateral direction | 6 | 10.9 |
| 39 | R-lat | R in lateral direction | 6 | 8.87 |
| 40 | RL-wd | R @ Liquidus - wd direction | 6 | 7.26 |
| 41 | dG/dx-lat | Derivative of G - lateral direction | | 5.90 |

In Table II, the abbreviations "wd" and "lat" mean a component of the feature in the mold withdrawal direction and in the lateral direction perpendicular to the mold withdrawal diection. The term "ECT" means equiaxed to columnar grain transition.

In the interest of normalization, all extracted data was transformed logarithmatically in order to allow the same order of magnitude for all of the 41 features or variables. Statistical anaylsis (Appendix A, A-2 through A-6) is performed on the data set to determine those features which were statistically significant and correlated to the aforementioned four grain categories. The statistical analysis can be carried out using a three step Fisher weight criteria to discern variance within the grain category for one feature or variable and compare variance for the grain category to the other grain categories.

Each feature or variable is then ranked (Appendix A, A-7) according to its significance with respect to variance among and between the aforementioned four grain categories. The determined input rank of the features or variables is shown in the left hand column of Table II. Also shown in the right hand column is the statistical coefficient Q used to gauge influence of each feature or variable. The "Ref." columnar identifies literature references that describe certain features or variables. The references are listed in Appendix D hereof.

For successful categorization, with any given feature or variable, it is desireable to obtain a large scatter between categories and a small variance within a category to obtain a large Q value as explained in detail in the aforementioned article by Kannatey-Asibu and Emel in Mech. Systems and Signal Processing, 4, 1987, pp. 333–347, the teachings of which are incorporated herein by reference. The data (computer data) which define each of the grain categories are called the training data set. The higher ranked features or variables will provide a sufficent distinction between grain categories and generally indicate a low overall scatter with an affintiy to one particular grain category. Features listed near the bottom of Table II likely will have very high values of scatter or variance when comapred to others. Consequently, the Q values are low and these features will not provide a strong indicator of grain category identification. It is interesting to note that the Q values of G and R are not among the top fifteen influential features or variables.

Following extraction of selected influential features or variables, pattern recognition analysis is perfomed as set forth in Appendix A, A-8 through A-14 to develop 3 variable linear discriminant functions (LDF's) which identify each grain category by a function containing values of each individual selected feature or variable. That is, the node data is categorized into the four grain categories using the LDF equations. The 3 variable LDF equations developed for the pattern recognition anaylsis are similar to regression equations but the output of each does not "fit" a curve, In this type of anaylsis, the output is compared against the output of an LDF for the other grain catergories for the same nodal point of the computer model. A categorization of classification matrix can be generated that identifies the node data with grain categories. According to the Baysean decision, the highest output value of all the LDF will determine into which category the given node data point is likely to fall. The LDF can be developed for any number of features.

Table III shows the results obtained from a particular training data set using 3 variable linear discriminant function anaylsis with three empirically chosen variables (R=solidficatin rate, G.R–wd=withdrawal direction component of the cooling rate vector, and GS–lat=the magnitude of the gradient calculated at the solidus temperature in a plane transverse to the withdrawal direction) selected from Table II (which also have been used to define the microsructural defect map and thus allow direct comparison). The top three features or variables of Table II were not used because the chosen variables yielded better results. It was desirable to obtain variables which were a great deal more independent and most accurately reflected observed grain conditions in casting trials. The chosen variables were obtained from full factorial orthogonal arrays of features to fine tune predictive capability.

TABLE III

Categorization Matrix Obtained From the 10730 Node Training Data Set Using a 3 Variable Linear Discriminant Function Analysis

| | True Category | | | |
|---|---|---|---|---|
| LDF Results | S-Xtal | DS Grains | Equiaxed Grains | Freckle Defects |
| S-Xtal | 100% | 9.9% | 37.8% | 9% |
| DS Grains | 0% | 87.5% | 31.9% | 18.9% |
| Equiaxed Grains | 0% | 0% | 28.3% | 0.9% |
| Freckle Defects | 0% | 2.4% | 2% | 71.2% |

TABLE IV

The Results Obtained from the 10730 Node Training Data Set Using the Criteria Functions from the Defect Map

| | True Category | | | |
|---|---|---|---|---|
| Results from Criteria Function | S-Xtal | DS Grains & Boundaries | Equiaxed Grains | Freckle Defects |
| DS/S-Xtal | 87.4% | 1.2% | 44.1% | 0% |
| Equiaxed Grains | 0% | 0% | 40.1% | 0% |
| Freckle Defects | 12.6% | 98.7% | 15.1% | 100% |

In every category, the prediction results from pattern recognition anaylsis are improved by a significant amount over the prediction results shown in Table IV obtained by comparing thermal histories to the criteria functions of the soldification defect map for the same defining models (Table I) wherein the criteria functions were G, R, cooling rate (G.R), and the equiaxed-to-columnar transition (G/R). The prediction results set forth in Table IV from the defect map reveal several discrepancies for the defining models such as the inability of defect map criteria to distinguish between directionally solidified and single crystal grain growth.

As expected, there remains in Table III some overlap between certain grain categories, especially between the equiaxed grain category and the others. This result tends to support observations that equiaxed grains heretofore observed in turbine blade single crystal castings in many cases were discovered to have grown as columnar grains.

Figure 3:
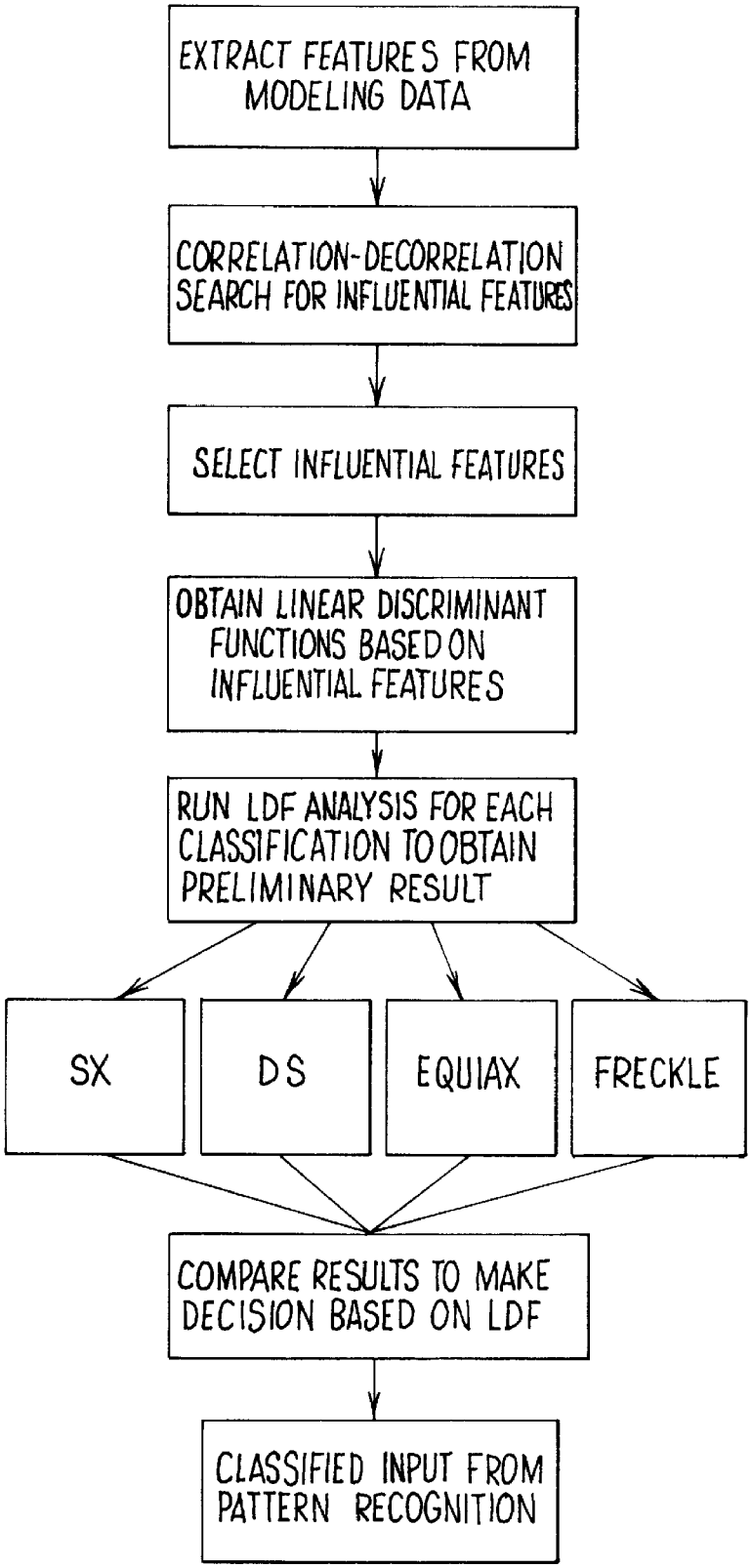
FIG. 3 is a flow chart for grain prediction in single crystal castings.

FIG. 3 is a flow chart representing the above-described steps in practicing an embodiment of the method of the invention using pattern recognition anaylsis in the manner described hereabove.

The training data predictions set forth in Table III were compared to observed grain conditons of test castings. The test castings comprised a slab casting approximately 12 cm in width by 40 cm in length by 1.6 cm in thickness poured from the Rene' N5 alloy on which the computer heat transfer computations were made using the Table I models. Four slab castings were made in a 4-piece cluster investment mold for single crystal soldification in a production single crystal soldification furnace of the type shown in FIG. 2. Following casting, each slab was examined and found to have numerous boundary defects (DS-grains-boundaries category). These defects occurred despite favorable process conditions in terms of G and R. The casting was computer modeled as described hereabove and the thermal history was examined using the LDF pattern recognition analysis as described hereabove for grain categorization. The casting also was modeled from the defect map criteria also described hereabove.

Figure 4A:
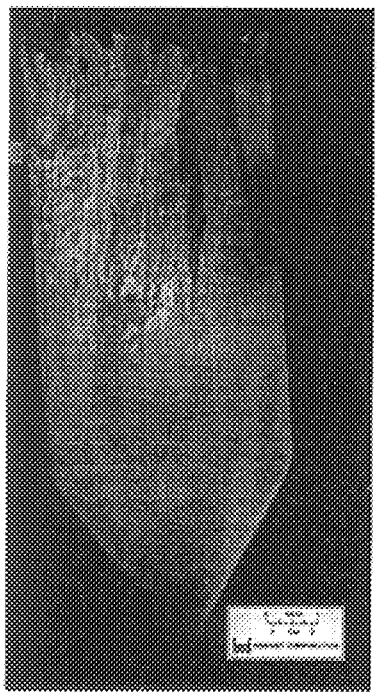
FIG. 4 provides comparative photographs of castings and computer drawings of the castings pursuant to a grain prediction method of the invention as well as numerical grain predictions based on a defect map.

FIG. 4*a* displays the results obtained from the casting (photographs in top row) and from the pattern recognition anaylsis of the thermal history data (computer drawings below photographs). Also noted are the results obtained from the defect map criteria (using 1177 node data points) stated below the computer drawings in terms of percent of the casting with a given grain condition. Numerous boundaries are identified using the LDF analysis which were not possible to predict using the defect map criteria. According to the specified defect map criteria, directional grain boundary type defects are not possible to examine, while the LDF pattern recognition anaylsis identified the observed grain boundaries correctly. Selection of the features or variables used in the LDF anaylsis required extensive testing until a match between predicted results and experimental casting results was obtained. Such testing involved computer model experiments using designed full tutorial orthogonal arrays to correlate the variables or features to actual casting results as a fine tune to the predictive capability of pattern recognition analysis.

The resultant LDF equation (from the aforementioned training data of Table III) used for the accurate prediction of FIG. 4 is displayed in Table VI wherein the coefficients and appropirate constants are given for each category and wherein a column in the table represents an entire equation (Appendix A, A-14) for that category.

TABLE VI

Linear Discriminant Functions of Grain Categories Obtained from the 10730 Node Training Data Set Using Three Input Variables. Values Represent Least Square Coefficients for the Variable Values. A Column Represents an Entire Equation for the Category.

| | S-Xtal | DS Grains | Equiaxed Grains | Freckle Defects |
|---|---|---|---|---|
| R | 0.0519 | −0.127 | 0.0396 | 0.0356 |
| G*R-wd | −0.0611 | 0.0339 | −0.0396 | 0.0669 |
| GS-lat | 0.0633 | 0.00871 | −0.0429 | −0.0296 |
| Constant | −0.290 | 0.498 | −0.340 | −0.867 |

In an attempt to improve the casting results (i.e. eliminate the boundary condition), a higher G and R combination was sought with a higher rate of mold withdrawal in additional casting trials to force the process parameters into what the defect map predicts is a more favorable region. The results are presented in FIG. 4*b*. Although many of the boundaries disappeared in both the casting and the prediction based on the defect map, it did not eliminate the boundary defects completely.

After numerous iterations of a computer heat transfer model, a lower more gradual G and R combination was determined to impact on boundary defects as described hereabove, and the thermal history was analyzed using LDF based pattern recognition techniques. The results of this LDF anaylsis (pattern recognition analysis) are displayed in FIG. 4*c* where it is evident that the boundaries have been eliminated in both the casting and the LDF prediction. A similar LDF analysis has been performed on numerous other component geometries with favorable results. The LDF analysis accounts for a distinction between single crystal grain and directional grains with boundaries which is not possible using the defect map.

The present invention applies pattern recognition to macroscopic soldification modeling data to identify and categorize inputs of grain type and assorted grain defects. Solidification control using pattern recognition developed using selected features or variables offers a marked improvement over the prediction techniques using criteria from a solidification defect map. The present invention utilizes directional resolution into mold withdrawal direction and lateral plane (perpendicular to the mold withdrawal direction) components as inputs to the LDF pattern recognition analysis to obtain improved grain category predictions.

While the invention has been described in terms of specific embodiments thereof, it is not intended to be limited thereto but rather only to the extent set forth in the following claims.

Appendix A

Pattern Recognition Background

Consider a data set extracted from the thermal history of a nodal position in a solidification model, represented as:

$$X=[x_1,x_2,x_3, \ldots x_n] \tag{A-1}$$

where $x_i$ is the value of a feature.

Next, we determine a mean feature component for each class, $$X_j = \frac{1}{M_i} \sum_{k_i}^{M_i} X_{ik} \tag{A-2}$$

where $M_i$=number of samples in class, i, and a global mean for all classes, represented as:

$$X = \sum_{i=1}^{c} p_i X_i \tag{A-3}$$

where $P_1$=a priori probability of class $C_1$

C=number of classes.

The scatter within each class is given by the covariance matrix:

$$R_i = \frac{1}{M_i} \sum_{k=1}^{M_i} (X_{ik} - X_i)(X_{ik} - X_i)^T \tag{A-4}$$

The scatter between individual classes is described by:

$$R_c = \sum_{i=1}^{c} p_i (X_i - X)(X_i - X)^T \tag{A-5}$$

and the scatter calculated for the overall system becomes:

$$R = \sum_{j=1}^{c} p_i R_i \tag{A-6}$$

We then define a selection criterion, Q, for describing the influential features which compare the differences between each class by comparing the j-th diagonal matrix elements of the scatter between the individual class ($R_c$) versus the scatter of the overall system (R) and is given by:

$$Q = \frac{R_c(j, j)}{R(j, j)} \tag{A-7}$$

We now develop selection criteria to determine the LDF coefficient values of each particular class. We will define a point in the decision space, $V_i$, as the point around which the cluster of points in a particular class is positioned. A matrix, $T_i$ will be the transformation matrix from the selected features to the decision space. The new pattern becomes:

$$S_{ij}=T_i X_{ij} \tag{A-8}$$

Since there is likely to be some error of individual points around $V_i$, we define an error vector after the transformation:

$$\epsilon_{ij}=S_{ij}-V_i=T_i X_{ij}-V_i \tag{A-9}$$

The total mean square error for class $C_i$ will be:

$$\epsilon_i = \frac{1}{M_i} \sum_{j=1}^{M_i} |\epsilon_{ij}|^2 \tag{A-10}$$

By differentiating (A-10) with respect to $T_i$, we obtain the overall transformation matrix:

$$T = \left[ \sum_{i=1}^{c} \sum_{j=1}^{M_i} \frac{p_i}{M_i} V_i X_{ij}^T \right] \left[ \sum_{i=1}^{c} \sum_{j=1}^{M_i} \frac{p_i}{M_i} X_{ij} X_{ij}^T \right]^{-1} \tag{A-11}$$

In order to classify an individual signal $S_{ij}$, the distance of this point from $V_i$ is defined as:

$$d_i^2=|S_{ij}-V_i|^2$$

$$i=1, 2, \ldots, C \tag{A-12}$$

By expanding (12), a minimum d value is obtained when the following function is a maximum:

$$g=VTX \tag{A-13}$$

The linear discriminant function is now defined as:

$$g_i(X)=w_{i1}x_1+w_{i2}x_2+ \ldots +W_{id}x_d+\theta \tag{A-14}$$

where

θ=constant or "threshold" of the function $w_{ik}$=least squares discriminant coefficients.

Appendix B

Assorted Criteria Functions used for Features in Pattern Recognition Analysis Mushy Zone Acceleration Ratio $$MAR = \frac{R_i}{R_s} \tag{B-1}$$

where $R_1$=solidification rate computed at liquidus $R_s$=solidification rate computed at solidus Cooling Rate Ratio (B-2)

$$\text{COOL} = \frac{(G^*R)_{wd}}{(G^*R)_{lat}}$$

where $(G^*R)_{wd}$=withdrawal direction component of cooling rate $(G^*R)_{lat}$=lateral plane direction component of cooling rate $$\text{COOL} = \frac{(G^*R)_{wd}}{(G^*r)_{lat}} \tag{B-2}$$

Appendix C

Description of Potential Feature Variables used in Pattern Recognition Analysis

| Variable Symbol | Variable Name | Description |
|---|---|---|
| G | Thermal gradient | Establishes the temperature loss per unit distance. Positive convention of this value will be defined as cooling from hot to cold. |
| G-w d | Gradient in the withdrawal direction | Resolves the overall gradient vector into the withdrawal direction component. A high value will favor <001> growth for DS/SC. |
| G-lat | Gradient in the plane normal to the withdrawal direction | Resolves the overall gradient vector into a component in the lateral plane. A high value may cause nucleation of additional grains. |
| GL | Gradient at the liquidus temperature | Establishes the temperature loss per unit distance during primary dendrite formation. A low value could cause an unreasonably large mushy zone. |
| GL-w d | Liquidus gradient in mold withdrawal direction | Resolves the liquidus gradient into a component in the primary growth direction. |
| GL-lat | Liquidus gradient in lateral plane | Resolves the liquidus gradient into a component in the plane of the secondary growth direction. |
| GS | Gradient at the solidus temperature | Establishes the temperature loss per unit distance during final stage of solidification. Should be about the same as GL for uniform DS/SC growth. |
| GS-w d | Solidus gradient in withdrawal direction | Resolves the solidus gradient into a component in the primary growth direction. |
| GS-lat | Solidus gradient in lateral plane | Resolves the solidus gradient into a component in the plane of the secondary growth direction. |
| R | Solidification rate | Velocity of the moving solid interface. With the value of G, the macroscopic solid interface type is established. |
| R-w d | Solidification rate in withdrawal direction | Velocity of the macroscopic solid interface in withdrawal direction. Should be smaller than R (overall) to ensure uniform DS/SC growth. |
| R-lat | Solidification rate in lateral plane | Velocity of the macroscopic solid interface in lateral plane. Can determine the, overall rate of dendrite coarsening. |
| G*R | Cooling rate - freckle criteria | Overall rate of cooling for the solid. A low rate of cooling promotes formation of freckles. |
| G*R-w d | Cooling rate in withdrawal direction | High values will favor <001> growth for DS/SC components. |
| G*R-lat | Cooling rate in lateral plane | High values will favor secondary growth other than <001>. |
| G/R | Solidification interface type - equiaxed to columnar transition criteria | Low values favor equiaxed grain growth. Higher values preferred for DS/SC. |
| $T_2$ | Local solidification time | Dwell time in the mushy zone for a given position. High values promote segregation, while low values promote equiaxed grain growth. |
| $dG/dx_i$ | Derivative of thermal gradient | Change in gradient with respect to distance. Low values favor uniform DS/SC growth. |
| dG/dx-w d | Derivative of gradient in withdrawal direction | Change in gradient over distance for primary growth direction. |
| dG/dx-lat | Derivative of gradient in lateral plane | Change in gradient over distance for secondary growth direction. |
| MAR | Mushy zone acceleration ratio | Ratio of velocities of liquidus isotherm to solidus isotherm. Greater than 1 indicates growing mushy zone size, less than 1 indicates shrinking mushy zone size. |
| MAR-w d | Mushy zone acceleration ratio in withdrawal | Large values may indicate potential for dendrite fragmentation. |

-continued

| Variable Symbol | Variable Name | Description |
|---|---|---|
| | direction | |
| MAR-lat | Mushy zone acceleration ratio in lateral plane | Small values may indicate potential for trapped solute and spurious grain nucleation. |
| COOL | Cooling rate ratio | Ratio of cooling rates in withdrawal direction to lateral direction. Higher values favor DS/SC growth. |
| COOL@liq | Cooling rate ratio at liquidus temperature | Higher values favor good <001> primary dendrite growth. |
| COOL@sol | Cooling rate ratio at solidus temperature | Very low values indicates significant secondary dendrite coarsening. |
| GROW | Directional growth ratio | Ratio of solidification rates in the withdrawal versus lateral directions. High values favor DS/SC growth. |
| GAP | Gradient acceleration parameter | See equations. Gives aggregate dendrite integrity. Lower values appear to favor DS/SC growth. |
| NIYAMA | Niyama porosity criteria | See equations. Higher values preferred to avoid porosity and interdendritic phenomena associated with segregation. |
| XUE | Xue porosity criteria | See equations and above description for Niyama criteria. |
| LCC | LCC porosity criteria | See equations and above description for Niyama criteria. |

APPENDIX D

References

1. Copely, et al., *Met. Trans.,* 1, 1970, pp. 2193–2204.
2. Yu, et al., *AFS Trans.,* 97, 1990, pp. 417–428.
3. Wright Patterson AFB, TR-91-8047, 1992.
4. Tu, Foran, *JOM,* 44, 1992, pp. 26–28.
5. Giamei, *JOM,* 45, 1993, pp. 51–53.
6. Purvis, et al., *AFS Trans.,* 96, 1994
7. Purvis, et al., *JOM,* 46, 1994, pp. 38–41.
8. Yu, et al., Superalloys 1992, 1992, pp. 135–144.
9. Pollock, et al., Superaloys 1992, 1992, pp. 124–134.
10. Imwikelried, et al., Modeling of Casting Welding and Adv. Solid. Processes VI, 1993, pp. 63–70,
11. Doctor, et al., Battelle Mem. Inst., PNL-3052, 1979.
12. Harrington, Doctor, Proc. of IEEE 5th Joint Conf. on Pattern Recognition, 1980, pp. 1204–1207.
13. Chan, et al., ibid., pp. 108–111.
14. Hay, et al., *J. of Acoustic Emission,* 3, 1984, pp. 135–144.
15. Kannatey-Asibu, Emel, *Mech. Systems and Signal Processing,* 4, 1987, pp. 333–347,
16. Hansen, *AFS Trans.,* 95, 1993

We claim:

1. A method of altering a grain condition in a directionally solidified casting, comprising generating thermal history data for a directional solidification casting process, determining a plurality of casting process variables that statistically influence a plurality of different grain conditions, identifying each grain condition by determining a function containing values of each selected variable, and categorizing the selected variables with respect to variance among and between the selected variables and the grain conditions, and altering a selected variable of the casting process to alter a grain condition of a casting made thereby.

2. The method of claim 1 wherein the thermal history data is generated from respective models representative of one of the grain conditions.

3. The method of claim 1 wherein the grain condition is identified by generating a linear discriminant function for each grain condition.

4. The method of claim 3 wherein the selected variables are categorized using the linear discriminant functions generated for each grain condition.

5. The method of claim 1 wherein one or more selected process variables are altered in the single crystal process to alter a grain condition of the single crystal casting.

* * * * *

UNITED STATES PATENT AND TRADEMARK OFFICE

CERTIFICATE OF CORRECTION

PATENT NO. : 5,841,669

DATED : 11/24/98

INVENTOR(S) : Purvis et al.

It is certified that error appears in the above-identified patent and that said Letters Patent is hereby corrected as shown below:

Column 2, line 46, replace "1*a* and 1*b*" with --1A and 1B--.

Column 2, line 49, replace "1*c*, 1*d* and 1*e*" with --1C, 1D and 1E--.

Figure 4B:
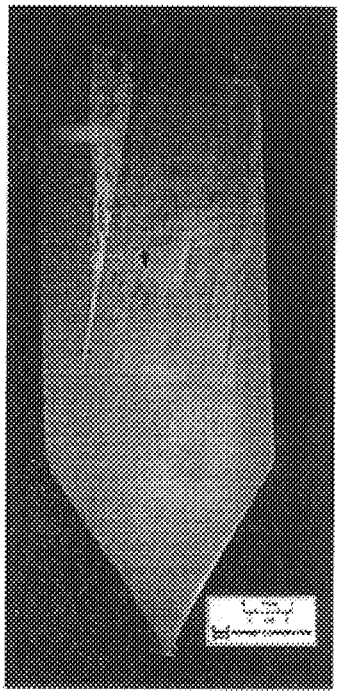
Figure 4C:
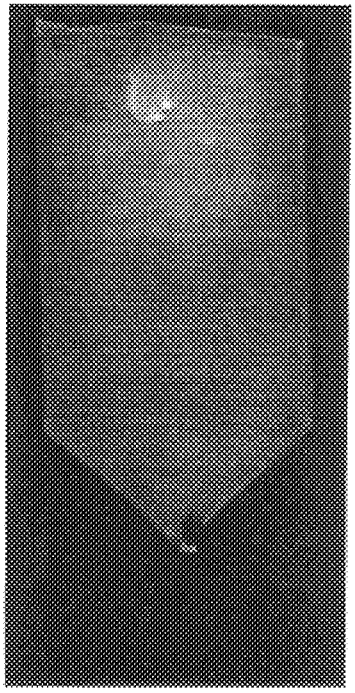
Figures 4A, 4B, 4C:
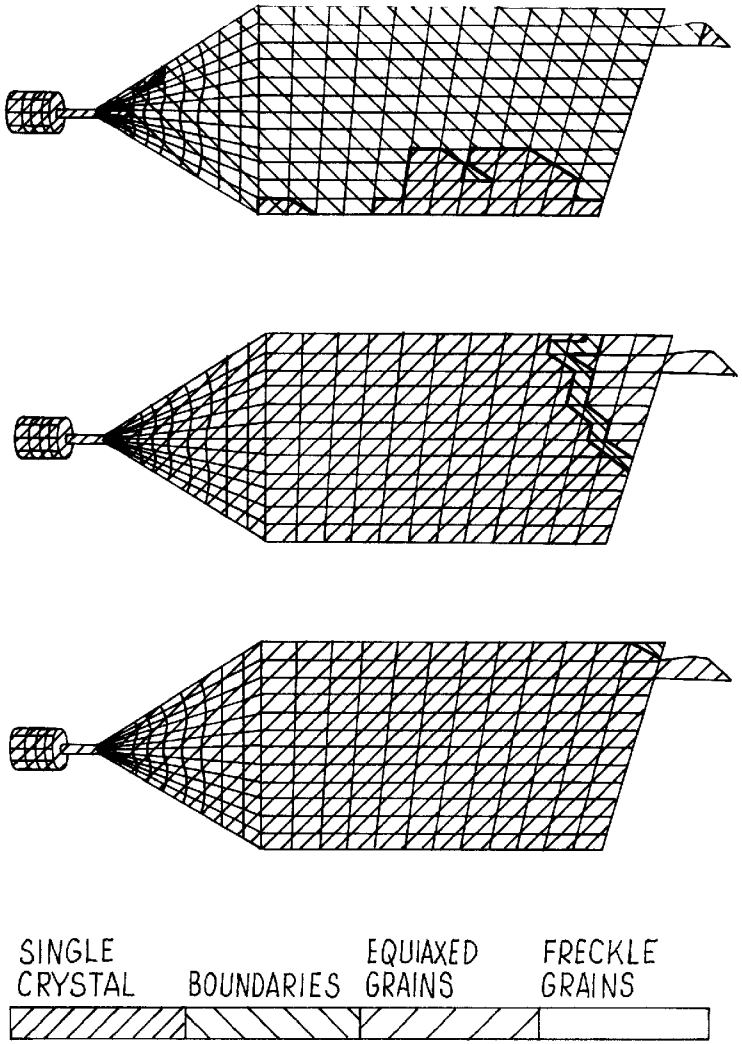

Column 2, line 58, replace " Figure 4 provides" with --Figures 4A, 4B and 4C provide--.

Column 4, line 19, replace "1*c*" with --1C--.

Column 4, line 20, replace "1*d*" with --1D--.

Column 4, line 21, replace "1*e*" with --1E--.

Column 4, line 32, replace "1*a*" with --1A--.

Column 4, line 39, replace "1*b*" with --1B--.

Column 8, line 1, replace "Figure 4*a* displays" with --Figures 4A, 4B, and 4C

Column 8, line 2, delete "in top row"

Column 8, line 4, replace "below" with --after--.

Signed and Sealed this

Twenty-third Day of February, 1999

*Attest:*

Q. TODD DICKINSON

*Attesting Officer*

*Acting Commissioner of Patents and Trademarks*